US012492520B2

(12) United States Patent
Roberge

(10) Patent No.: US 12,492,520 B2
(45) Date of Patent: Dec. 9, 2025

(54) EXTENDABLE PLOW BLADE

(71) Applicant: ATELIER D'USINAGE JULES ROBERGE INC., St-Pierre-de-l'Île-d'Orléans (CA)

(72) Inventor: Jules Roberge, Saint-Pierre-de-l'Île-d'Orléan (CA)

(73) Assignee: ATELIER D'USINAGE JULES ROBERGE INC., St-Pierre-de-l'Île-d'Orléans (CA)

( * ) Notice: Subject to any disclaimer, the term of this patent is extended or adjusted under 35 U.S.C. 154(b) by 731 days.

(21) Appl. No.: 17/857,320

(22) Filed: Jul. 5, 2022

(65) Prior Publication Data

US 2023/0010870 A1 Jan. 12, 2023

Related U.S. Application Data

(60) Provisional application No. 63/219,899, filed on Jul. 9, 2021.

(51) Int. Cl.
*E01H 5/06* (2006.01)

(52) U.S. Cl.
CPC ..... *E01H 5/065* (2013.01)

(58) Field of Classification Search
CPC ..... E02F 5/065; E02F 5/061; E02F 5/067
USPC ..... 37/274, 281
See application file for complete search history.

(56) References Cited

U.S. PATENT DOCUMENTS 3,782,573 A * 1/1974 Garwood ..... E02F 3/401 414/722
4,275,514 A * 6/1981 Maura ..... E01H 5/065 37/281
RE31,045 E * 10/1982 Essell ..... E01H 5/065 172/777
5,392,538 A * 2/1995 Geerligs ..... E01H 5/068 37/236

(Continued)

OTHER PUBLICATIONS

Metal Pless. Snow Plow Inversemaxx EXT. https://www.metalpless.com/en/products/snow-plow/32/metalpless-inversemaxx-ext. Retreived on Jun. 10, 2021.

(Continued)

*Primary Examiner* — Jamie L Mcgowan
(74) *Attorney, Agent, or Firm* — Norton Rose Fulbright Canada LLP

(57) ABSTRACT

A plow blade securable to a vehicle, has: a central section having: a central panel, and a member secured to the central panel via a transversal rib, the member defining at least one channel; two lateral sections having: lateral panels having lateral and medial edges, the lateral panels defining slots, and beams secured to the lateral panels and protruding from the medial edges, the beams slidably received within the at least one channel; and at least one actuator operatively connected to the central section and the two lateral sections, wherein the two lateral sections are movable relative to the central section between a collapsed configuration and an extended configuration, the two lateral sections being overlapped by the central section in the collapsed configuration and being offset from the central section in the extended configuration, in the collapsed configuration, portions of the transversal rib are received within the slots.

19 Claims, 14 Drawing Sheets

(56) References Cited

U.S. PATENT DOCUMENTS 6,408,549 B1 * 6/2002 Quenzi ..... E01H 5/066 37/281
6,442,877 B1 * 9/2002 Quenzi ..... E01H 5/065 37/281
7,429,158 B2 * 9/2008 McFarland ..... E02F 3/401 414/722
7,681,337 B2 * 3/2010 Watson ..... E01H 5/065 37/274
8,528,237 B1 * 9/2013 Bacall ..... E01H 5/061 37/231
8,850,724 B2 * 10/2014 Bloxdorf ..... E01H 5/067 37/283
8,887,413 B2 * 11/2014 Miller ..... E02F 3/815 37/444
10,106,942 B2 * 10/2018 Roberge ..... E01H 5/067
11,293,149 B2 * 4/2022 Schuette ..... E01C 19/42
11,459,717 B2 * 10/2022 Côté ..... E01H 5/061
11,466,418 B2 * 10/2022 Sankovic ..... E01H 5/065
2003/0226289 A1 * 12/2003 Geerligs ..... E01H 5/06 37/268
2007/0089327 A1 * 4/2007 Watson ..... E01H 5/065 37/281
2009/0307943 A1 * 12/2009 Buckbee ..... E01H 5/066 37/266
2010/0088930 A1 * 4/2010 Brame ..... E02F 3/815 37/231
2014/0250740 A1 * 9/2014 Supergan ..... E01H 5/065 37/281
2016/0251825 A1 * 9/2016 Landry ..... E01C 19/187 172/817
2022/0112674 A1 * 4/2022 Strait ..... E01H 5/066

OTHER PUBLICATIONS

Cotech. PPCR-SKST. https://www.cotech.ca/produits/pprc-skst1/ppcr-skst. Retreived on Jun. 10, 2021.

* cited by examiner

EXTENDABLE PLOW BLADE

CROSS-REFERENCE TO RELATED APPLICATIONS

This application claims priority from U.S. patent application 63/219,899 filed on Jul. 9, 2021. Its content is incorporated herewith in its entirety.

TECHNICAL FIELD

This disclosure generally relates to the field of snow removable devices and, more particularly, to plow blades that are extendable.

BACKGROUND

Plow blades are typically mounted to vehicles for moving a material (e.g. snow) from a road or similar surface. These blades are typically curved, e.g. somewhat C-shaped, with the concave face being designed for engagement with the snow. Plow blades can be used obliquely relative to the direction of the vehicle for pushing the material to a side, or transversally to the direction of the vehicle for pushing the material forwardly. Some snow plow blades, commonly referred to as "snow pushers" are specifically designed for pushing snow, and are provided with side walls which protrude forwardly at each transversal end for keeping the snow contained therebetween, against the blade.

SUMMARY

In one aspect, there is provided a plow blade securable to a vehicle, comprising: a central section having: a central panel, and a member secured to the central panel via a transversal rib, the member defining at least one channel; two lateral sections having: lateral panels having lateral and medial edges, the lateral panels defining slots extending from the medial edges toward the lateral edges, and beams secured to the lateral panels, the beams protruding from the medial edges and away from the lateral edges, the beams slidably received within the at least one channel; and at least one actuator operatively connected to the central section and the two lateral sections for moving the two lateral sections relative to the central section, wherein the two lateral sections are movable relative to the central section between a collapsed configuration and an extended configuration by a sliding motion of the beams within the at least one channel, the two lateral sections being overlapped by the central section in the collapsed configuration and being offset from the central section in the extended configuration, wherein, in the collapsed configuration, portions of the transversal rib are received within the slots, a width of the plow blade in the extended configuration is about double that in the collapsed configuration.

The plow blade may include any of the following features, in any combinations.

In some embodiments, the member is secured to a first side of the central panel, the transversal rib extending through the central panel from the first side to a second side opposed to the first side.

In some embodiments, at least one attachment member secured to the transversal rib on the second side of the central panel for securing the plow blade to the vehicle, a load path extending from the at least one attachment member on the second side of the central panel to the first side of the central panel via the member and via the transversal rib, a pulling force exerted on the at least one attachment member translated into a pushing force exerted on the beams via the member and via the transversal rib.

In some embodiments, the member is a C-shaped member having a web and two flanges, each of the two flanges protruding from a respective edge of the web, the transversal rib secured to the web, the at least one channel including two channels each located between a respective one of the two flanges and the transversal rib.

In some embodiments, the at least one channel includes two channels separated by the transversal rib.

In some embodiments, the two channels are vertically atop one another.

In some embodiments, the beams are vertically atop one another.

In some embodiments, a top portion of the central panel defines at least one top channel, the two lateral sections having stabilizing beams protruding from the medial edges and slidably received within the at least one top channel.

In some embodiments, the stabilizing beams are in front of one another.

In some embodiments, the at least one top channel includes two top channels, each of the stabilizing beams slidably receivable within a respective one of the two top channels.

In some embodiments, the beams are telescopic.

In some embodiments, friction blocks are mounted to the central panel, the friction blocks in contact with the beams and made of a material having a friction coefficient less than that of the beams.

In some embodiments, the at least one actuator includes two actuators, the two actuators overlapping one another.

In some embodiments, longitudinal panels are secured to the lateral panels, the longitudinal panels extending transversally to the lateral panels, ends of the beams aligned with apertures or cut-outs defined by the longitudinal panels to allow snow to be pushed out of gaps defined between the longitudinal panels and the ends of the beams.

In another aspect, there is provided a plow blade securable to a vehicle, comprising: a central section having: a central panel, and a member secured to the central panel via a transversal rib, the member defining at least one channel; two lateral sections having: lateral panels having lateral and medial edges, and beams secured to the lateral panels, the beams protruding from the medial edges and away from the lateral edges, the beams slidably received within the at least one channel; and at least one actuator operatively connected to the central section and the two lateral sections for moving the two lateral sections relative to the central section, wherein the two lateral sections are movable relative to the central section between a collapsed configuration and an extended configuration by a sliding motion of the beams within the at least one channel, the two lateral sections being overlapped by the central section in the collapsed configuration and being offset from the central section in the extended configuration, wherein, in the collapsed configuration, portions of the transversal rib are received within the slots, a width of the plow blade in the extended configuration is about double that in the collapsed configuration.

The plow blade may include any of the following features, in any combinations.

In some embodiments, the member is secured to a first side of the central panel, the transversal rib extending through the central panel from the first side to a second side opposed to the first side.

In some embodiments, at least one attachment member is secured to the transversal rib on the second side of the central panel for securing the plow blade to the vehicle, a load path extending from the at least one attachment member on the second side of the central panel to the first side of the central panel via the member and via the transversal rib, a pulling force exerted on the at least one attachment member translated into a pushing force exerted on the beams via the member and via the transversal rib.

In some embodiments, the member is a C-shaped member having a web and two flanges, each of the two flanges protruding from a respective edge of the web, the transversal rib secured to the web, the at least one channel including two channels each located between a respective one of the two flanges and the transversal rib.

In some embodiments, the beams are telescopic beams.

In some embodiments, a top portion of the central panel defines at least one top channel, the two lateral sections having stabilizing beams protruding from the medial edges and slidably received within the at least one top channel.

Many further features and combinations thereof concerning the present improvements will appear to those skilled in the art following a reading of the instant disclosure.

DETAILED DESCRIPTION

Figure 1:
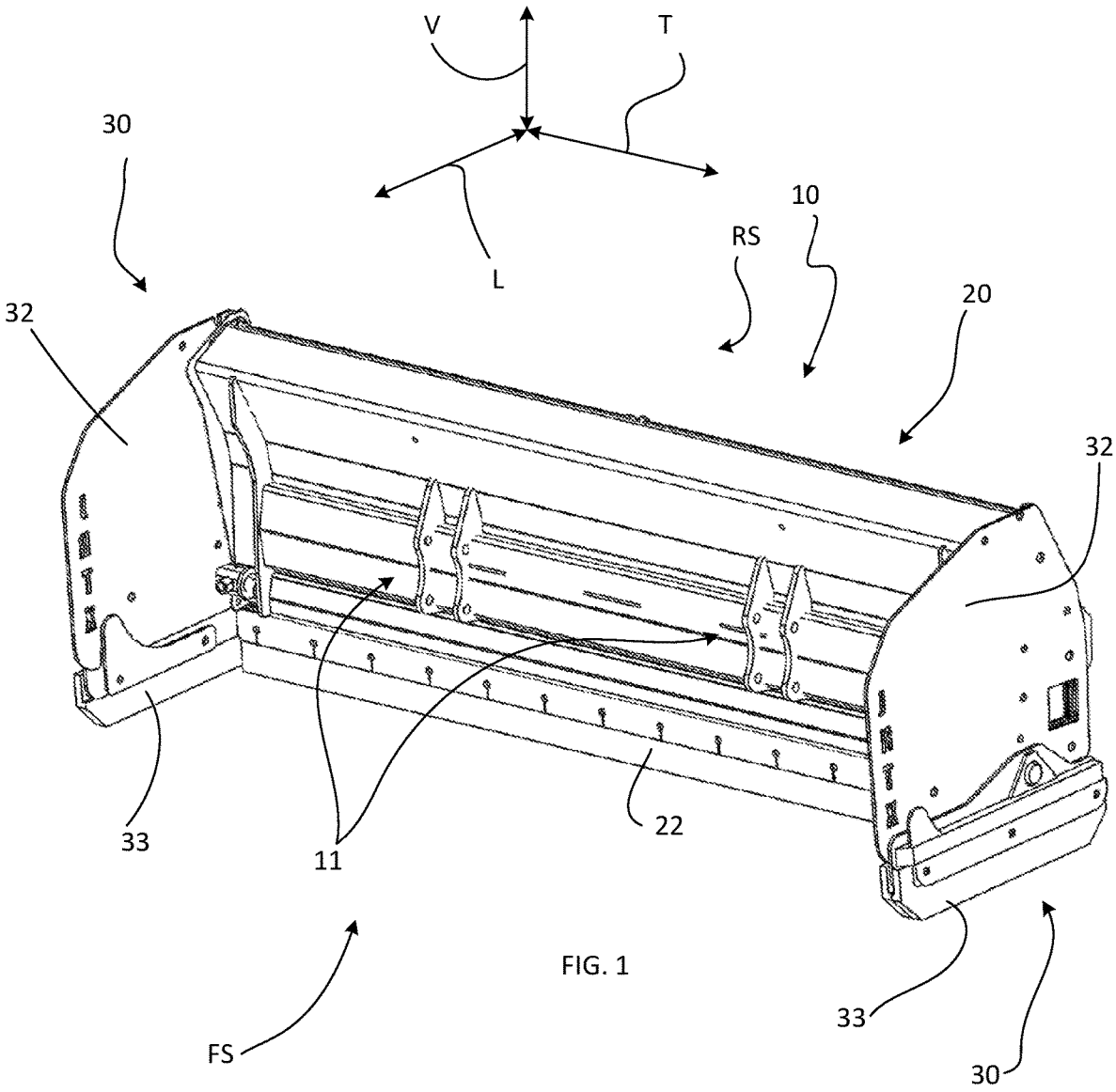
FIG. 1 is a front three dimensional view of a plow blade in accordance with one embodiment shown in a collapsed configuration.

FIG. 1 shows an example of a plow blade 10 adapted for mounting to a vehicle (not shown). The plow blade 10 is adapted to push or pull snow with the vehicle, but it will be understood that it can be used to push or pull other materials than snow if desired, and that alternate embodiments can even be specifically adapted to another material than snow. The plow blade 10 defines a longitudinal direction L, a transversal direction T normal to the longitudinal direction L, and a vertical direction V normal to both of the longitudinal direction L and the transversal direction T. The longitudinal direction L may generally correspond to a direction of travel of the vehicle equipped with the plow blade 10. The plow blade 10 has a front side FS and a rear side RS opposed to the front side FS. The front side FS faces a direction of travel of the vehicle when snow is being pulled. In the embodiment shown, the front side FS is concave to help dragging snow. In the present case, the plow blade 10 is designed to be secured to a rear end of the vehicle to pull the snow along the direction of travel. The dragged snow may then be located between the vehicle and the plow blade 10. The disclosed plow blade 10, and all embodiments of the plow blade described herein, may however be used as a push blade to push the snow along the direction of travel without departing from the scope of the present disclosure.

Figure 2:
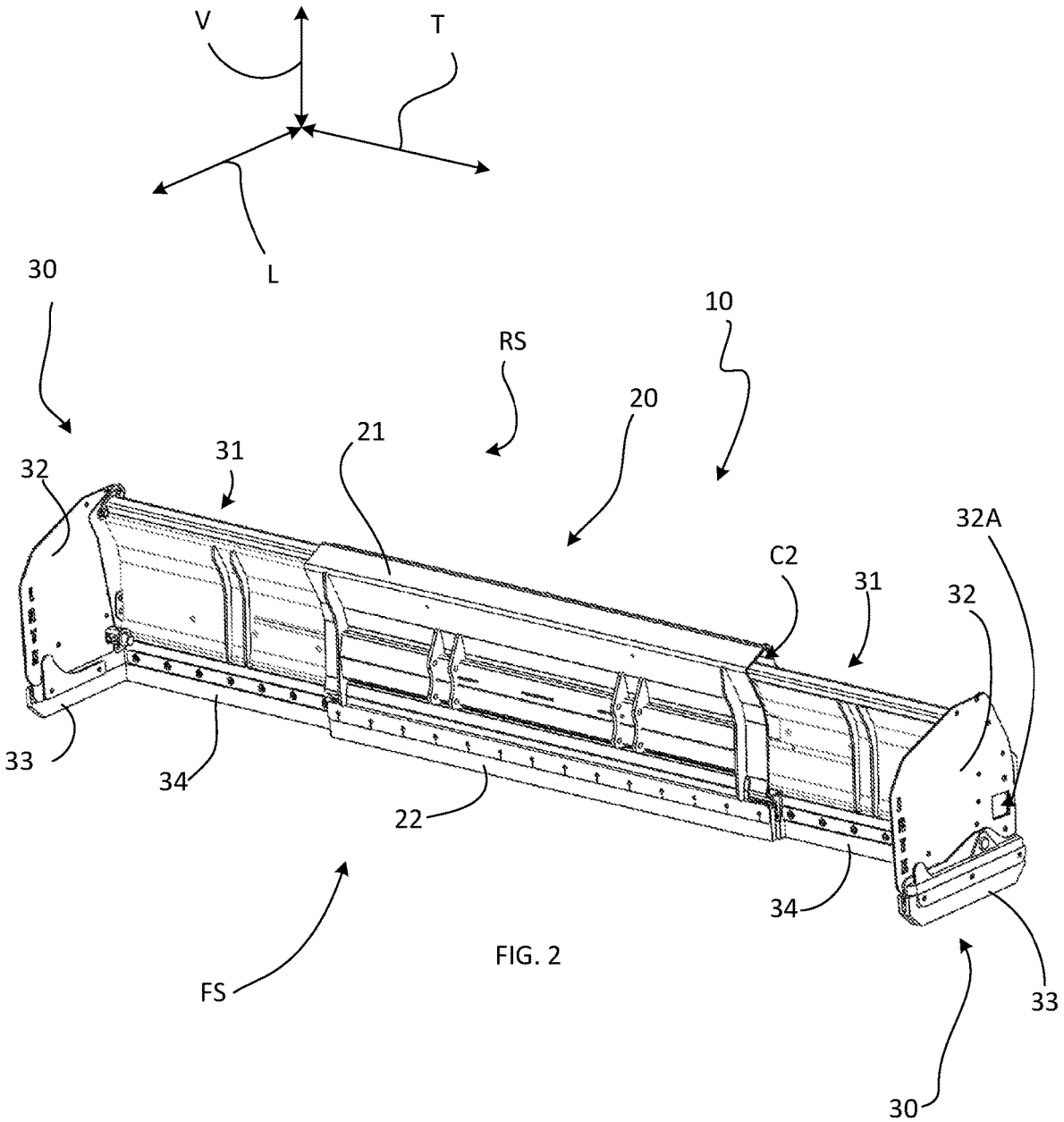
FIG. 2 is a front three dimensional view of the plow blade of FIG. 1 shown in an extended configuration.

The plow blade 10 is extendable from a collapsed configuration depicted in FIG. 1 to an extended configuration depicted in FIG. 2. In the present embodiment, a width of the plow blade 10 in the extended configuration and taken along the transverse direction T is about twice that in the collapsed configuration. The width may thus be extended from, for instance, six feet to twelve feet. Features allowing this extension are described in more detail below. Herein, the expression "about" implies variations of plus or minus 10%.

The plow blade 10 has a central section 20 and two lateral sections 30. The two lateral sections 30 move away from one another along the transversal direction T and relative to the central section 20 to extend the plow blade 10 from the collapsed configuration of FIG. 1 to the extended configuration of FIG. 2. The central section 20 is described below with reference numerals in the 20's and the lateral sections 30 are described with reference numerals in the 30's.

In the present embodiment, the plow blade 10 is securable to the vehicle via the central section 20. That is, the two lateral sections 30 are secured to the vehicle via the central section 20. Two pairs of brackets 11 are secured to the central section 20 and are used as an interface between the plow blade 10 and the vehicle. Any other suitable means for securing the plow blade 10 to the vehicle are contemplated without departing from the present disclosure.

Figure 3:
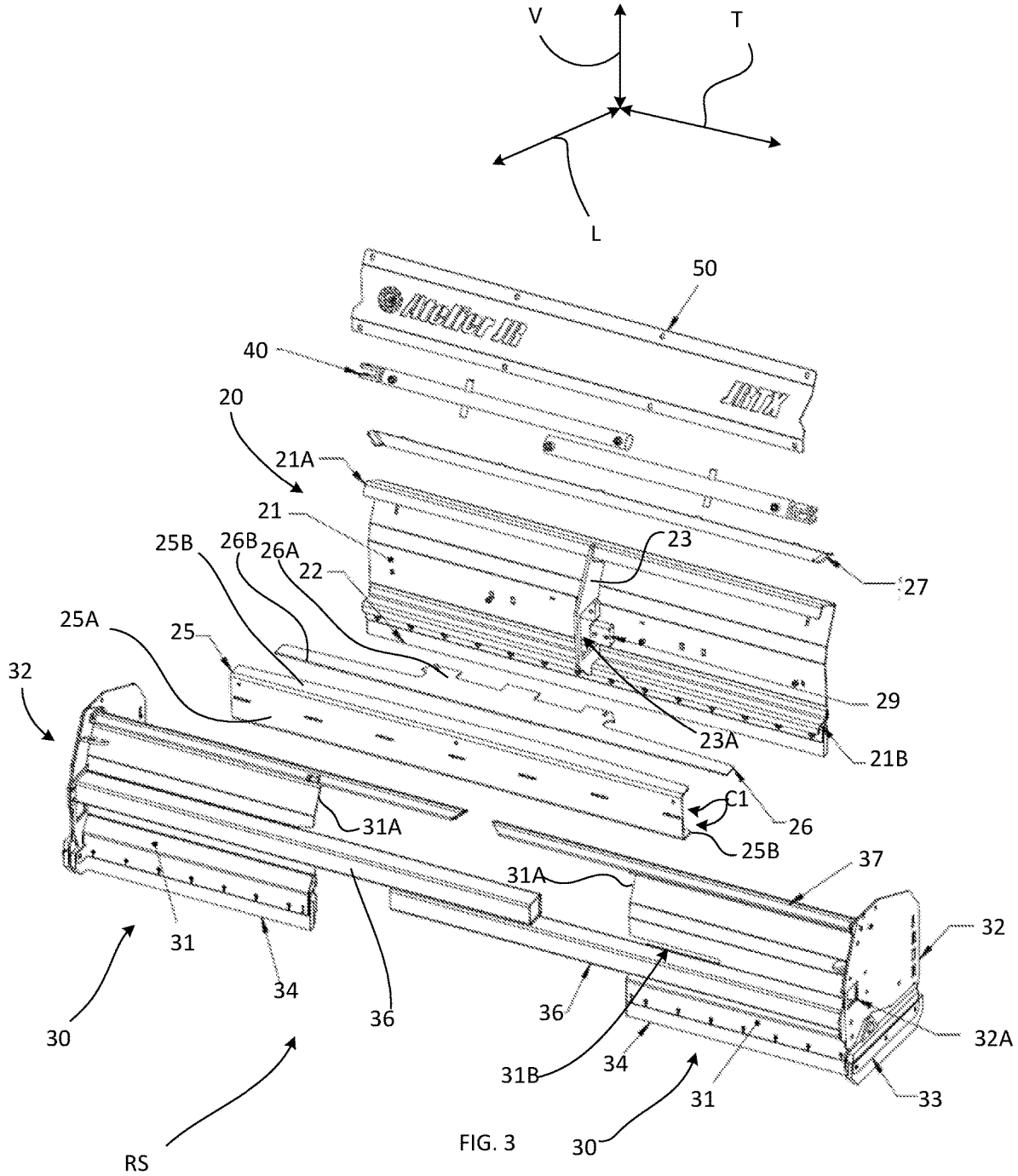
FIG. 3 is a rear three dimensional exploded view of the plow blade of FIG. 1.
Figure 4:
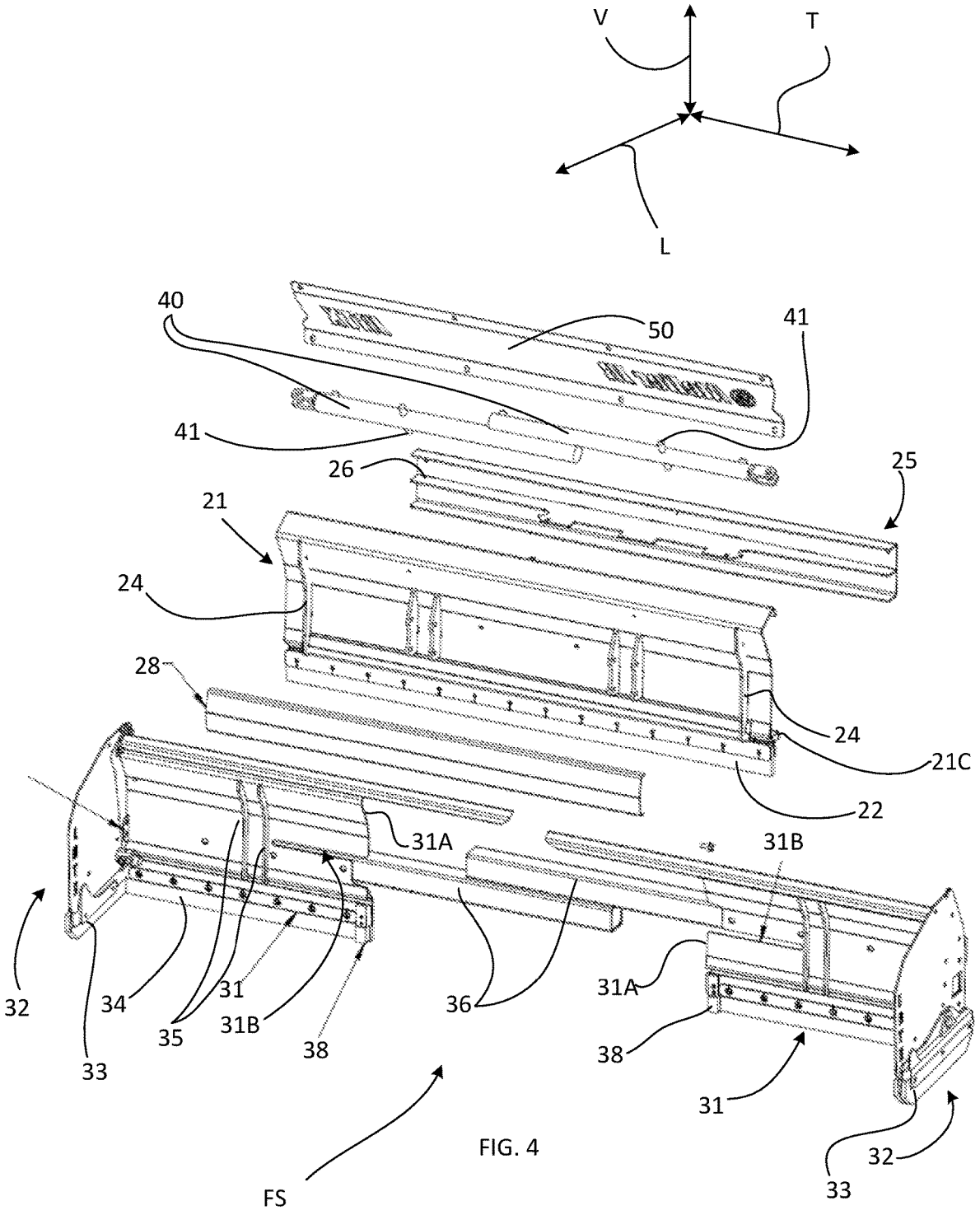
FIG. 4 is a front three dimensional exploded view of the plow blade of FIG. 1.

Referring to FIGS. 3-4, the central section 20 has a central panel, referred to below as a panel 21 and a blade 22 mounted at a lower edge of the panel 21. The blade 22 may be fastened to the panel 21 and is used for rubbing against a ground for dragging the snow. The two pairs of brackets 11 are secured to the panel 21, more specifically, to a forward side of the panel 21. A central rib 23 protrudes from a rear side of the panel 21 along the longitudinal direction L and is located between the two pairs of brackets 11. The central rib 23 extends substantially vertically along the vertical direction V. The central rib 23 defines an aperture 23A, which is rectangular in the disclosed embodiment although other shapes are contemplated. As explained below, this aperture 23A is sized to accept beams of the lateral sections 30 to allow extension of the plow blade 10.

As shown in FIG. 3, the top edge of the panel 21 curves toward the rear side RS to define a stabilizing rail 21A that provides stiffness to the panel 21. The stabilizing rail 21A may be a separate component secured (e.g., fastened, welded) to the panel 21 or may be monolithic with the panel 21 as in the case in FIG. 3. In the embodiment shown, a rail splitter 27 is secured to the panel 21 within the stabilizing rail 21A to create two top channels C2 (FIG. 2) within the stabilizing rail 21A. The rail splitter 27 may be, in an alternate embodiment, part of the panel 21. The lower edge of the panel 21 may curve toward the rear side RS to define a guiding rail 21B, which may also increase a stiffness of the panel 21.

Figure 6:
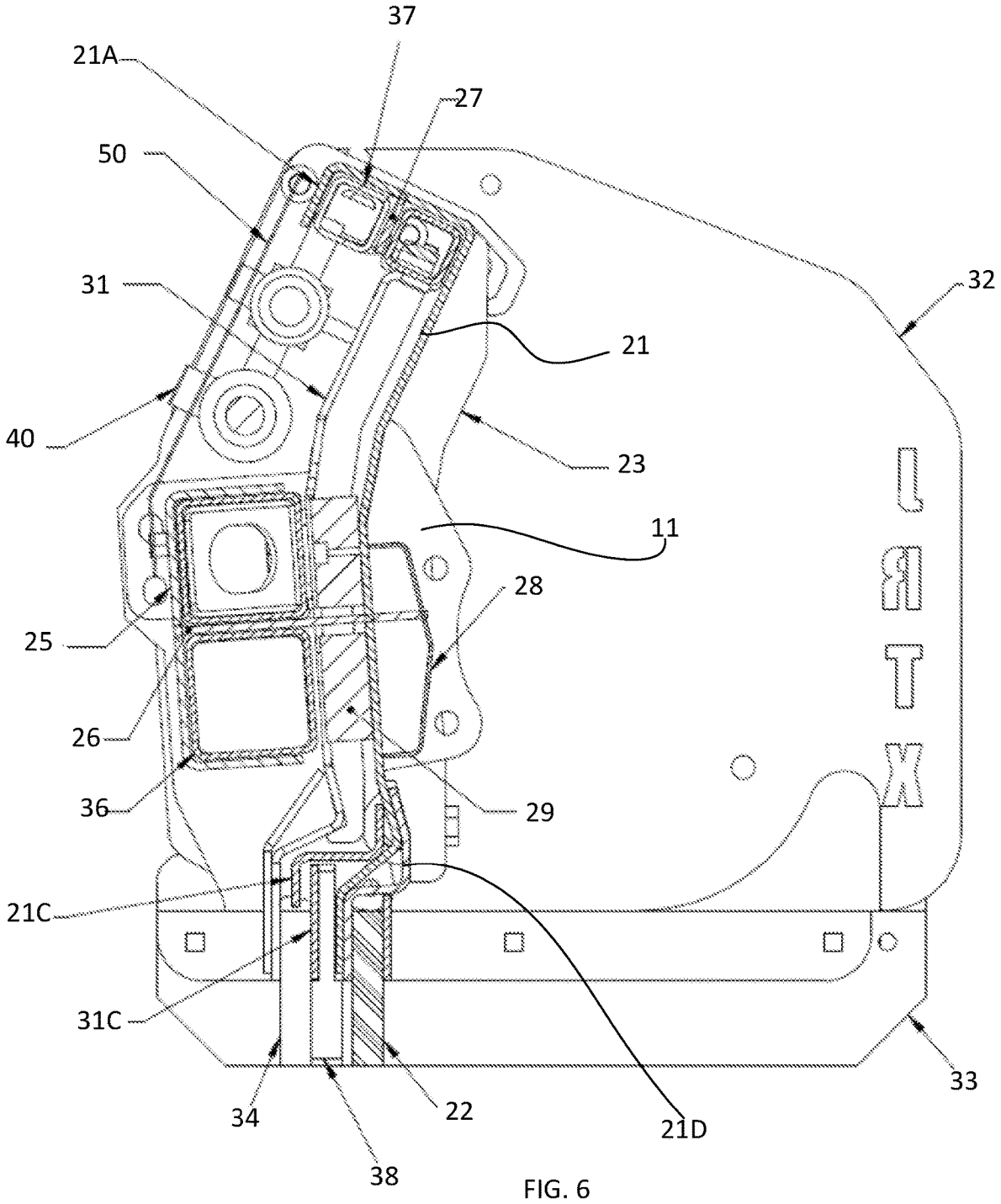
FIG. 6 is a side cutaway view of the plow blade of FIG. 1.

Referring now to FIGS. 3 and 6, in the embodiment shown, the guiding rail 21B is defined by a secondary panel 21C secured to the panel 21 proximate the bottom edge of the panel 21. The blade 22 of the central section 20 is secured to the panel 21 via a tertiary panel 21D. The tertiary panel is secured (e.g., welded, fastened) to the panel 21. The tertiary panel 21D may add stiffness to a bottom of the central section 20.

Figure 5:
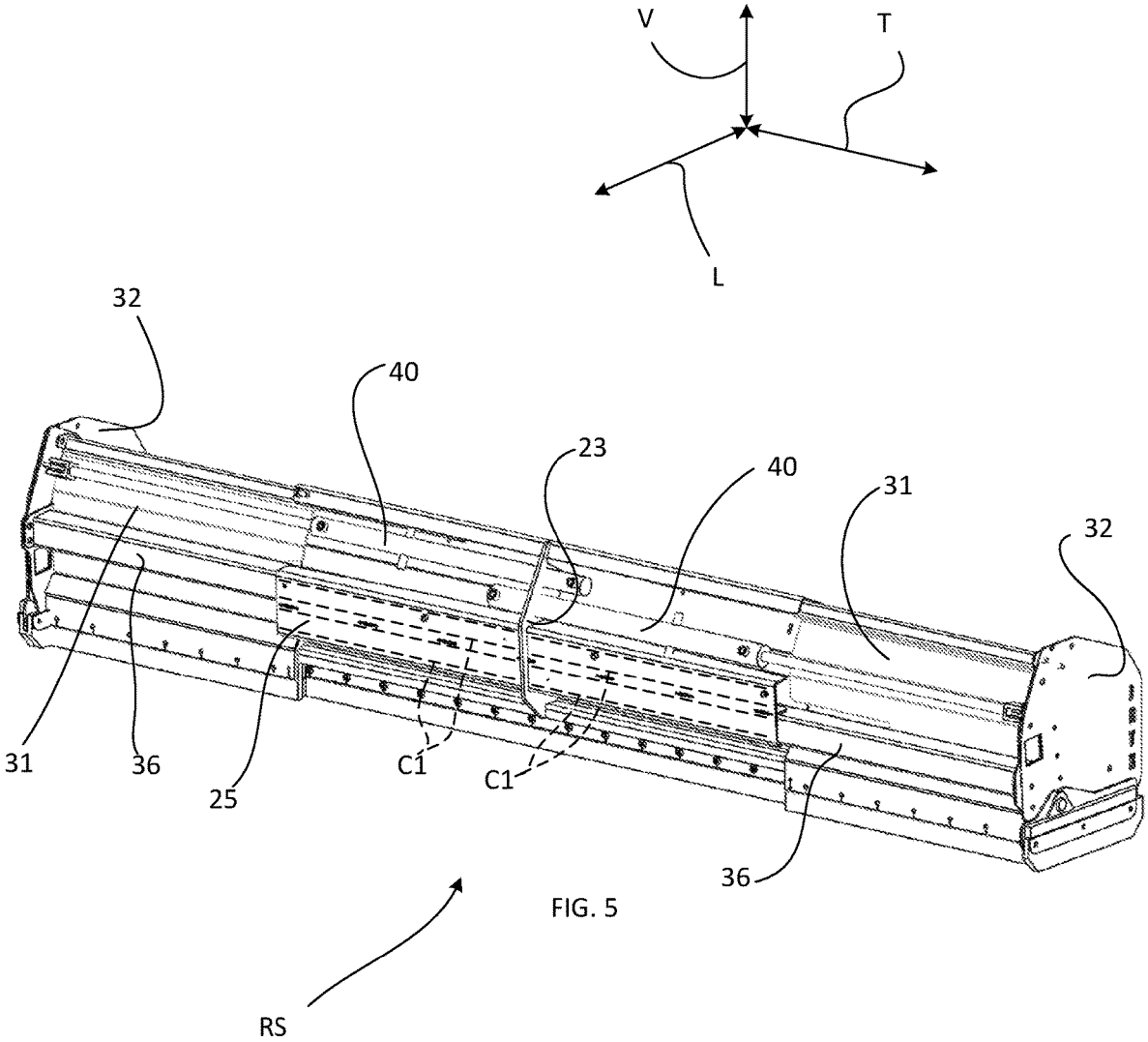
FIG. 5 is a rear three dimensional view of the plow blade of FIG. 1 in the extended configuration.

Still referring to FIG. 3, a member, referred to herein as an extension box 25, is secured to the rear side of the panel 21 via a transversal rib 26. The transversal rib 26 is secured to the rear side of the panel 21 and extends generally longitudinally from the panel 21. The extension box 25 and the transversal rib 26 extends along the transversal direction T. The extension box 25 includes a web 25A and two flanges 25B secured to top and bottom edges of the web 25A and vertically spaced apart from one another by the web 25A. The flanges 25B extend transversally to the web 25A. The transversal rib 26 is secured to the web 25A between the two flanges 25B to define two primary channels C1 to receive beams of the lateral sections 30 to allow the extension of the plow blade 10 as will be discussed further below. The two primary channels C1 are separated by the transversal rib 26. As shown in FIG. 5, the transversal rib 26 and the extension box 25 are received within the aperture 23A defined by the central rib 23. In some alternate embodiments, only one primary channel may be provided.

As shown in FIG. 4, side ribs 24 are secured to the front side of the panel 21. These side ribs 24 may extend substantially vertically and may increase a stiffness of the panel 21. A stiffening box 28 is secured to the front side of the panel 21 and extends from one of the two side ribs 24 to the other. The stiffening box 28 extends through apertures defined by the brackets 11 and is secured (e.g., fastened, welded) to the front side of the panel 21. The stiffening box 28 may contribute in increasing a stiffness of the panel 21. In the embodiment shown, the stiffening box 28 and the extension box 25 are located on respective opposite sides of the panel 21 of the central section 20. This may allow to better distribute forces on the central section 20.

Referring to FIGS. 3-4, the two lateral sections 30 are now described. Each of the lateral sections 30 includes a transversal panel 31 and a longitudinal panel 32 being generally transverse to one another. The longitudinal panel 32 extends along the longitudinal direction L forwardly toward the direction of travel and is used to limit snow from escaping the plow blade 10. The transversal panels 31 are generally parallel to the central section 20 of the plow blade 10 and defines the extensions of the plow blade 10. That is, the transversal panels 31 move relative to the central section 20 to extend and collapse the plow blade 10.

In some embodiments, the longitudinal panels 32 may be moved along the longitudinal direction L relative to the transversal panels 31 from a pull configuration depicted in FIG. 1 to a push configuration. Hence, in the push configuration, the longitudinal panels 32 are forward of a remainder of the plow blade 10 to push the snow. This is described in U.S. Pat. No. 10,106,942, the entire contents of which are incorporated by reference herein. Any of the embodiments disclosed herein may be equipped with longitudinal panels being movable longitudinally to use the plow blade in a pusher or puller configuration.

Skates 33 may be located at bottom edges of the longitudinal panels 32 and are used to contact the ground during a snow removal operation. The skates 33 may be movable along the vertical direction V relative to the longitudinal panels 32 to follow the shape of the ground. Any suitable means allowing relative motion between the longitudinal panels 32 and the skates 33 are contemplated. Blades 34 are secured (e.g., fastened) to bottom edges of the transversal panels 31 to drag the snow. Stiffening ribs 35 are secured to the front side of the transversal panel 31 and extend substantially vertically. The stiffening ribs 35 may further help stiffening the transversal panels 31.

Referring more particularly to FIG. 3, an extension beam 36 is secured to the rear side of the transversal panel 31 of each of the two lateral sections 30. The extension beams 36 protrude beyond medial edges 31A of the transversal panels 31. The extension beams 36 of the two lateral sections 30 are vertically offset from one another. In other words, the extension beams 36 of the two lateral sections 30 are atop one another. This is shown more clearly in FIG. 6. As shown in FIG. 5, these extension beams 36 are received into the primary channels C1 defined by the extension box 25. Hence, a length of the extension beams 36 in the transverse direction T is selected such that a portion of the extension beams 36 remains in the primary channels C1 when the plow blade 10 is in the extended configuration as shown in FIG. 5. In some embodiments, the extension beams 36 may be telescopic. The transversal rib 26 separates the two channels C1 such that the extension beams 36 are not rubbing against one another during movements of the lateral sections 30 relative to the central section 20. This may ease the movements of the lateral sections 30.

The two extension beams 36 may help in resisting a moment about an axial parallel to the vertical direction V. In other words, when the snow blade 100 is used to pull or push snow, a force is exerted on the lateral sections 30 that results in a moment about the axis parallel to the vertical direction. This moment attempts to rotate the two lateral sections 30 relative to the central section 20. This moment is counteracted by the two extension beams 36. In other words, a torsional stiffness of the snow blade 10 about an axis parallel to the vertical direction is increased by the two extension beams 36. Furthermore, the two extension beams 36 may help in limiting rotation of the plow blade 10 about an axis parallel to the transversal direction T. Stated differently, a torsional stiffness of the plow blade 10 about the axis parallel to the transversal direction T may be increased by the two extension beams 36. The extension beams 36 are used to transmit a pulling/pushing force from the vehicle to the lateral sections 30.

As shown in FIG. 3, each of the longitudinal panels 32 of the lateral sections 30 may define an aperture 32A. The apertures 32A are aligned with ends of the extension beams 36 and are used to provide an outlet for snow that may accumulate on the extension beams 36. Hence, when the plow blade 10 is moved toward the collapsed configuration of FIG. 1, the snow that is pushed by the ends of the extension beams 36 is pushed out via the apertures 32A to avoid the snow from impeding movements of the lateral sections 30 relative to the central section 20. These aperture 32A may allow to increase a ratio of a width of the plow blade 10 in the extended configuration to the width in the collapsed configuration because it may not be required to maintain a clearance between the ends of the extension beams 36 and the longitudinal panels 32 of the lateral sections 30. Indeed, the apertures 32A may allow the snow to escape and there may be no risk of snow being caught between the longitudinal panels 32 and the ends of the extension beams 36 thanks to the apertures 32A.

The medial edges 31A of the transversal panels 31 may abut the central rib 23 of the panel 21 of the central section 20 when the plow blade 10 is in the collapsed configuration. However, the transversal rib 26, which connects the panel 21 of the central section 20 to the extension box 25, may limit movements of the lateral section 30 because the medial edges 31A may abut against the transversal rib 26 before the central rib 23. In the embodiment shown, this is alleviated by having slots 31B defined in the transversal panels 31. The slots 31B extend from the medial edges 31A toward the longitudinal panels 32, which are secured to lateral edges of the transversal panels, and are sized to receive a portion of the transversal rib 26 when the plow blade 10 is in the collapsed position to allow the transversal panel 31 to be substantially fully overlapped by the central section 20. This may allow the doubling of the width of the plow blade 10 between the collapsed and extended configurations (e.g., from 6-7 feet to 12-14 feet in total width).

More specifically, and shown in FIG. 3, the transversal rib 26 has a first portion 26A extending from the panel 21 of the central section 20 and a second portion 26B extending from the extension box 25. The first portion 26A has a width in the transversal direction T being less than that of the second portion 26B. The slots 31B of the lateral sections 30 are sized to receive each about half of the width of the first portion 26A to permit the medial edges 31A of the transversal panels 31 of the lateral sections 30 to abut the central rib 23. In some embodiments, the medial edges 31A remain spaced apart from the central rib 23 in the collapsed configuration.

In the depicted embodiment, two friction blocks 29 are secured to the rear side of the panel 21 of the central section 20. The two friction blocks 29 may be located proximate the central rib 23 and each is in abutment against a respective one of the extension beams 36. The friction blocks 29 may be made of a material having a low coefficient of friction, such as Teflon™, to ease movements of the lateral sections 30 relative to the central section 20. The friction blocks 29 may further provide a spacing between the extension beams 36 and the panel 21 of the central section 20 to ease movements of the lateral sections 30. In use, when the snow is being pulled by the plow blade 10, the extension beams 36 may be biased against the friction blocks 29 instead of against the panel 21. This may provide a smaller area of contact, and reduced friction, compared to a configuration in which the friction blocks 29 are absent and in which the extension beams 36 are biased directly against the panel 21.

The friction blocks 29 may provide a spacing between the panel 21 and the extension beams 36. This may prevent snow from accumulating between the panel 21 and the extension beams 36, which may otherwise impede a sliding motion of the lateral sections 30 relative to the central section 20. A width of the friction blocks 29 in the transversal direction T may be substantially less than a width of the extension beams 36.

In the embodiment shown, each of the two lateral sections 30 includes a stabilizing beam 37 secured to a respective one of the transversal panels 31 and protrude beyond the medial edges 31A of the transversal panels 31. The stabilizing beams 37 are located proximate top edges of the transversal panels 31. As shown more clearly in FIG. 6, the two stabilizing beams 37 are located longitudinally in front of one another. This may provide a better rigidity than if the two stabilizing beams 37 were disposed vertically atop one another. Each of the stabilizing beams 37 is received within a respective one of the top channels C2 defined by the stabilizing rail 21A of the panel 21 of the central section 20. The two stabilizing beams 37 may be separated from one another by the rail splitter 27, which may prevent contact between the two stabilizing beams 37. This may ease extension and contraction of the plow blade 10. In some embodiments, the stabilizing beams 37 may be telescopic.

The two stabilizing beams 37, by being disposed one in front of the other, may help in resisting a moment about an axis parallel to the vertical direction V. In other words, when the snow blade 100 is used to pull or push snow, a force is exerted on the lateral sections 30 that result in a moment about the axis parallel to the vertical direction. This moment attempts to rotate the two lateral sections 30 relative to the central section 20. This moment is counteracted by the two stabilizing beams 37 disposed in front one another. In other words, a torsional stiffness of the snow blade 10 about an axis parallel to the vertical direction is increased by the two stabilizing beams 37. Furthermore, the two stabilizing beams 37 may help in limiting rotation of the plow blade 10 about an axis parallel to the transversal direction T. Stated differently, a torsional stiffness of the plow blade 10 about the axis parallel to the transversal direction T may be increased by the two stabilizing beams 37.

Referring to FIGS. 4 and 6, in the embodiment shown, two blockers 38 are secured to the blades 34 of the lateral sections 30 and/or to the transversal panels 31 and are located between the blades 34 of the lateral sections 30 and the blades 22 of the central section 20. The two blockers 38 have lower ends that are aligned with lower edges of the blades 34 are used to prevent snow from accumulating between the blades 22, 34 of the central and lateral sections 20, 30.

Referring to FIGS. 3 and 6, in the embodiment shown, the blades 34 of the lateral sections 30 are secured to the transversal panels 31 via a plate 31C secured to the transversal panels 31 proximate a bottom edge thereof. This may increase a stiffness of the lateral sections 30.

In use, the vehicle pulls on the plow blade 10 via the two pairs of brackets 11. The force is transmitted to the panel 21 of the central section 20 and from the panel 21 to the transversal rib 26. From the transversal rib 26, the force is transmitted to the extension beams 36 via the extension box 25. The force is then transmitted to the longitudinal panels 32 and the transversal panels 31 of the lateral sections 30 via the extension beams 36. Therefore, the pulling force exerted on the central section 20 becomes a pushing force on the extension beams 36 and on the lateral sections 30. When the plow blade 10 is in the extended configuration of FIG. 2, the weight of the snow exerts moments on the lateral sections 30 about axes substantially parallel to the vertical direction V. These moments are counteracted by the portions of the extension beams 36 remaining inside the extension box 25 to maintain the lateral sections 30 substantially parallel to the central section 20. These moments are further counteracted by the stabilizing beams 37 received within the stabilizing rail 21A of the central section 20. This may allow the width of the plow blade 10 to be substantially doubled while maintaining adequate stiffness to carry the weight of the snow.

Stated differently, the extension box 25 is secured to a first side of the central panel 21 and the transversal rib 26 extends through the central panel 21 from the first side to a second side opposed to the first side. The attachment member (e.g, bracket 11) is/are secured to the transversal rib 26 on the second side of the central panel 21 for securing the plow blade 10 to the vehicle. A load path extends from the at least one attachment member on the second side of the central panel 21 to the first side of the central panel 21 via the box 25 and via the transversal rib 26. A pulling force exerted on the at least one attachment member is thus translated into a pushing force exerted on the beams 36 via the box 25 and via the transversal rib 26. In the present embodiment, the box 25 is a C-shaped member having a web and two flanges. Each of the two flanges protrudes from a respective edge of the web. The two flanges of the extension box 25 may be secured (e.g., welded, brazed) to the second side of the central panel 21 to exert a pushing force on the central panel 21. The transversal rib 26 is secured to the web and the two channels are each located between a respective one of the two flanges and the transversal rib 26. Herein, the two channels are disposed vertically atop one another.

Referring more particularly to FIG. 5, in the embodiment shown, two actuators 40, which may be hydraulic actuators or any other suitable actuators such as pneumatic actuators, are used to extend and collapse the plow blade 10. Each of the two actuators 40 has a first end secured to a respective one of the lateral sections 30 and a second end secured to the central section 20. The first ends of the two actuators 40 may be secured proximate junctions between the longitudinal panels 32 and the transversal panels 31 of the lateral sections. The second ends of the two actuators may be secured to the panel 21 of the central section 20 and/or to the central rib 23. The actuators 40 may elongate and contract to move the lateral sections 30 between the collapsed and extended configurations. In some cases, one or more than two actuators may be used.

As shown in FIG. 5, each of the actuators 40 includes first and second concentric sections movable one relative to the other between extended and collapsed positions. For each of the actuators 40, the first concentric section is secured at its extremity to a respective one of the lateral sections 30, herein to the longitudinal panel 32, and the second concentric section secured to the central section 20, herein to the panel 21. In the embodiment shown, the second concentric sections are secured between extremities of the second concentric sections. This may decrease a length between the two attachment points of the actuators 40 compared to a configuration in which the second concentric section is secured to the panel 21 at its extremity. This reduced length may avoid buckling of the actuators 40 when the plow blade 10 is in the extended configuration. This may further avoid requiring increasing a diameter of the actuators 40, which may decrease a speed at which the plow blade 10 may be moved between the extended and collapsed configurations. In some cases, the second concentric sections of the actuators 40 are secured to the central section 20 at about one eighth of the length of the second concentric sections, in some cases at about one fourth of the length, and in some cases at about two third of the length, and in some other cases about half of the length.

As shown in FIG. 4, dowels 41 are used to secured the second concentric sections to the central section 20 at an intermediary location between extremities of the second concentric sections. However, it will be understood that any other securing means may be used to secure the actuators 40 to the central section 20.

Referring back to FIG. 3, in the embodiment shown, a protective plate 50 is secured to the central section 20 to cover the two actuators 40. The protective plate is secured to the rear side of the central section 20 and may be secured to a top edge of the panel 21 of the central section 20 and/or to the central rib 23 and/or to the extension box 25. The protective plate 50 may be used to protect the actuators 40 from the snow.

Referring now to FIGS. 7-10, another embodiment of a plow blade is shown at 100. For the sake of conciseness, only elements differing from the plow blade 10 described above with reference to FIGS. 1-6 are described below.

Figure 7:
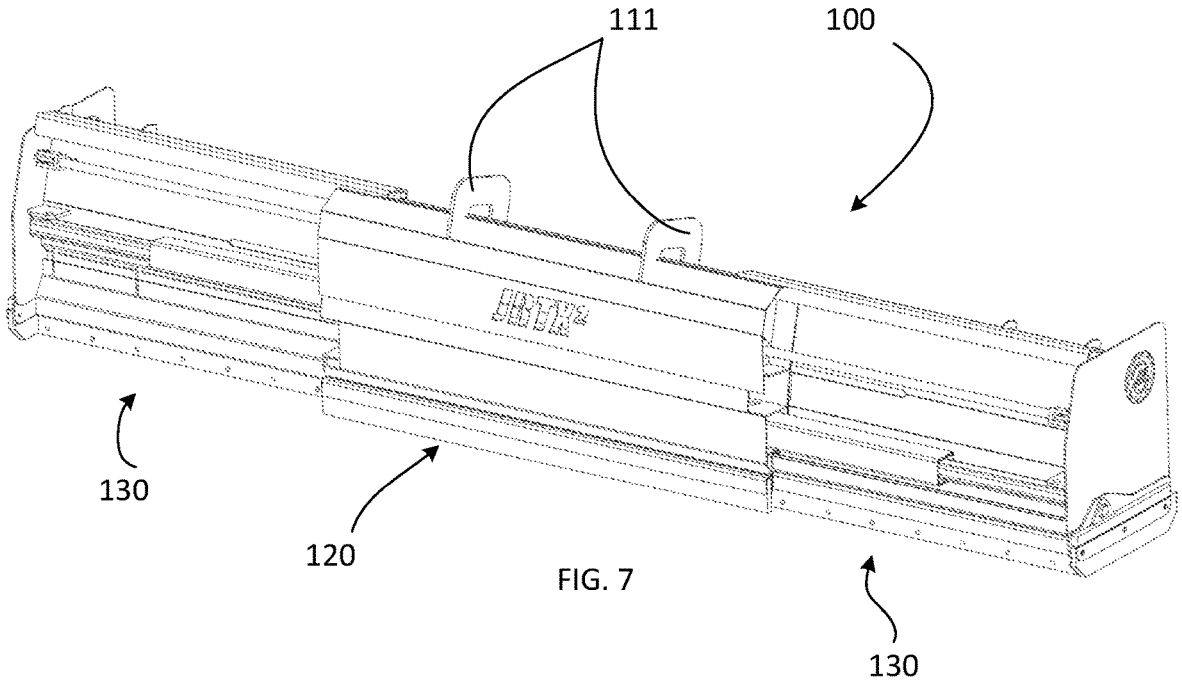
FIG. 7 is a rear three dimensional view of a plow blade in accordance with another embodiment shown in an extended configuration.
Figure 8:
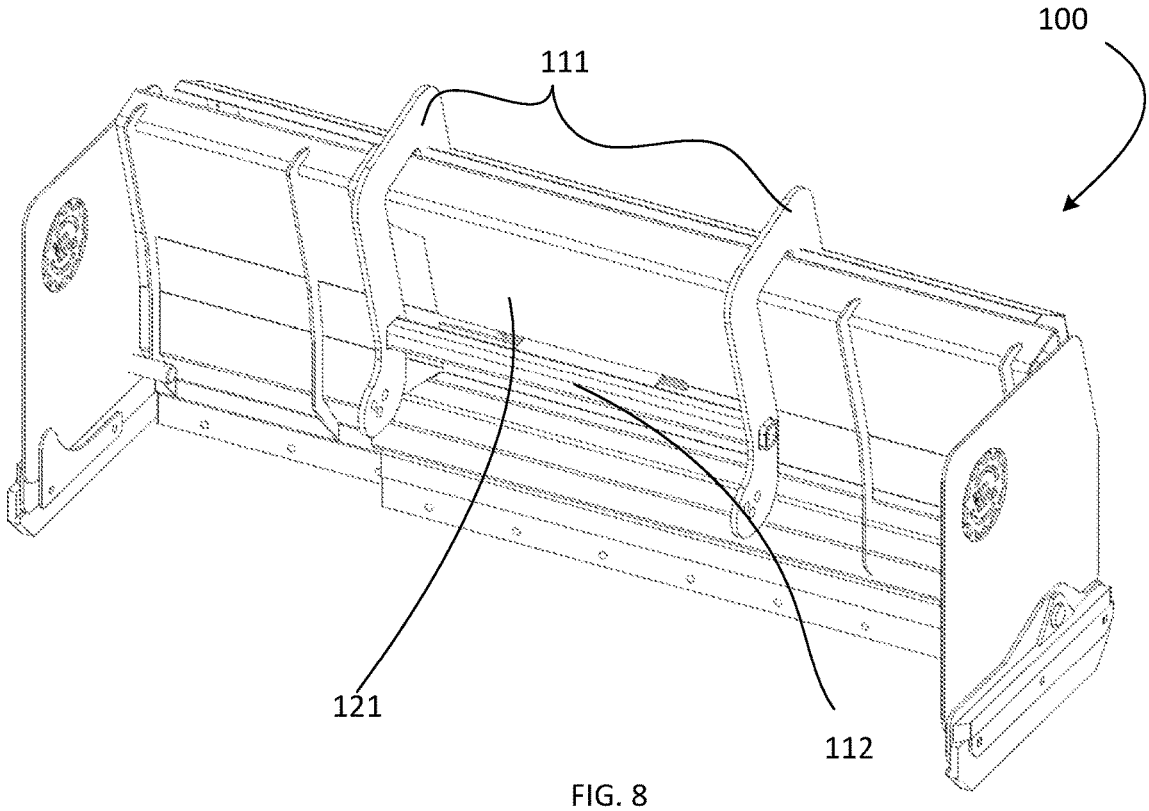
FIG. 8 is a front three dimensional view of the plow blade of FIG. 7 shown in a collapsed configuration.

The plow blade 100 has a central section 120 and two lateral sections 130 that are movable relative to the central section 120 to extend the plow blade 100 from a collapsed configuration shown in FIG. 8 to an extended configuration shown in FIG. 7. The central section 120 includes a panel 121 and two arms 111 secured to the panel 121. The two arms 111 are interconnected by a transversal arm 112. The transversal arm 112 is used as an interface between the plow blade 100 and a vehicle (not shown). In the present embodiment, the two arms 111 partially wrap around a top portion of the central section 120.

Figure 9:
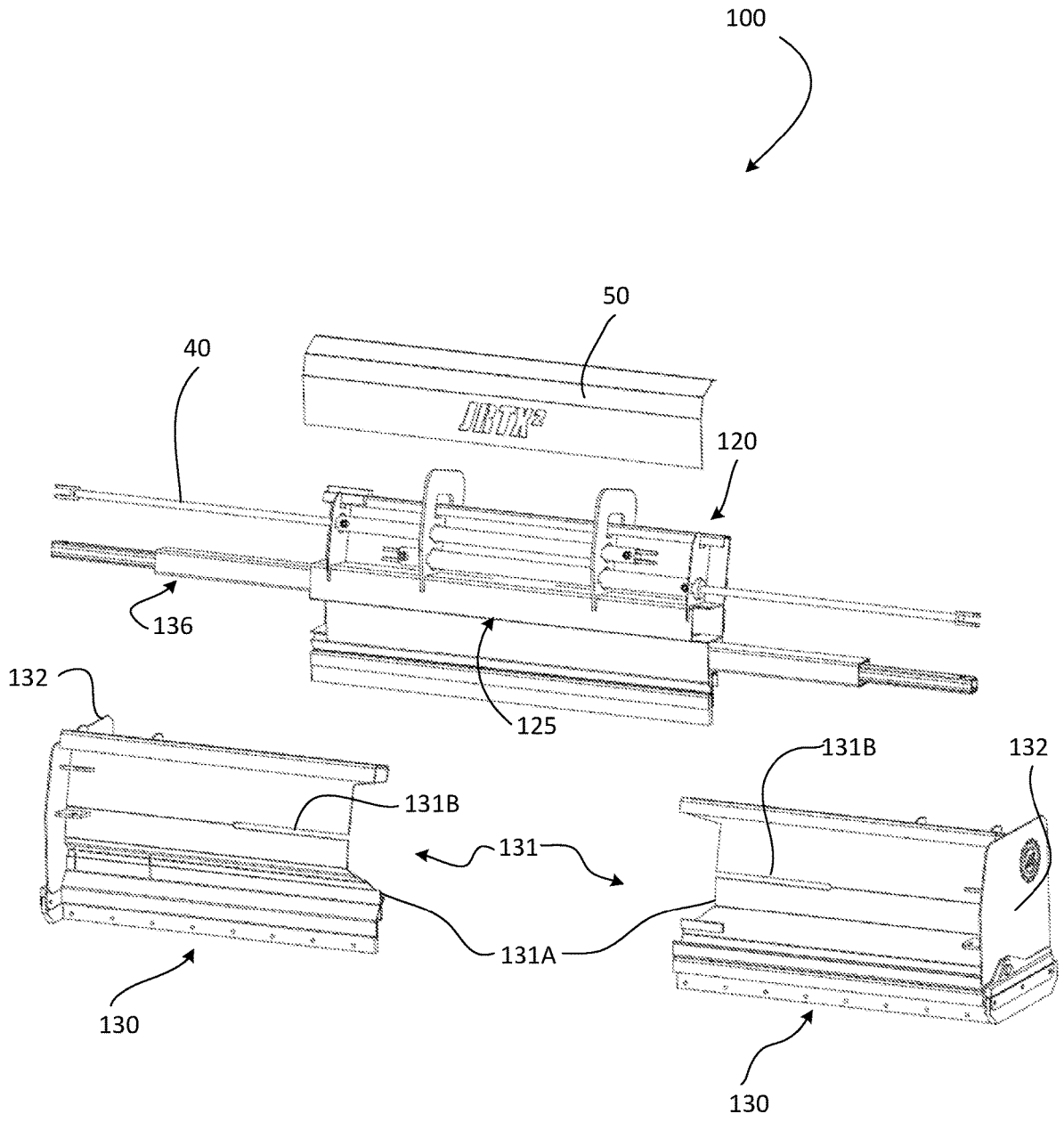
FIG. 9 is a rear three dimensional exploded view of the plow blade of FIG. 7.

In the embodiment shown, the two lateral sections 130 are secured to the central section 120 via extension beams 136 that are telescopic in the present embodiment as illustrated more clearly in FIG. 9. The extension beams 136 in the present embodiment each include two sections; one of the two sections slidably received within the other of the two sections. The extension beams 136 have first ends secured to the central section 120 and second ends secured to longitudinal panels 132 of the lateral sections 130. The extension beams 136 run substantially parallel to transversal panels 131 of the two lateral sections 130. Any suitable shape (e.g., round, square, etc) for the extension beams 136 is contemplated.

As described above, the transversal panels 131 of the two lateral sections 130 define slots 131B extending from medial edges 131A of the transversal panels 131. The slots 131B are sized to accept a transversal rib 126 that is secured to the panel 121 of the central section 120. The transversal arm 112 is secured to the transversal rib 126 in the present embodiment.

Figure 10:
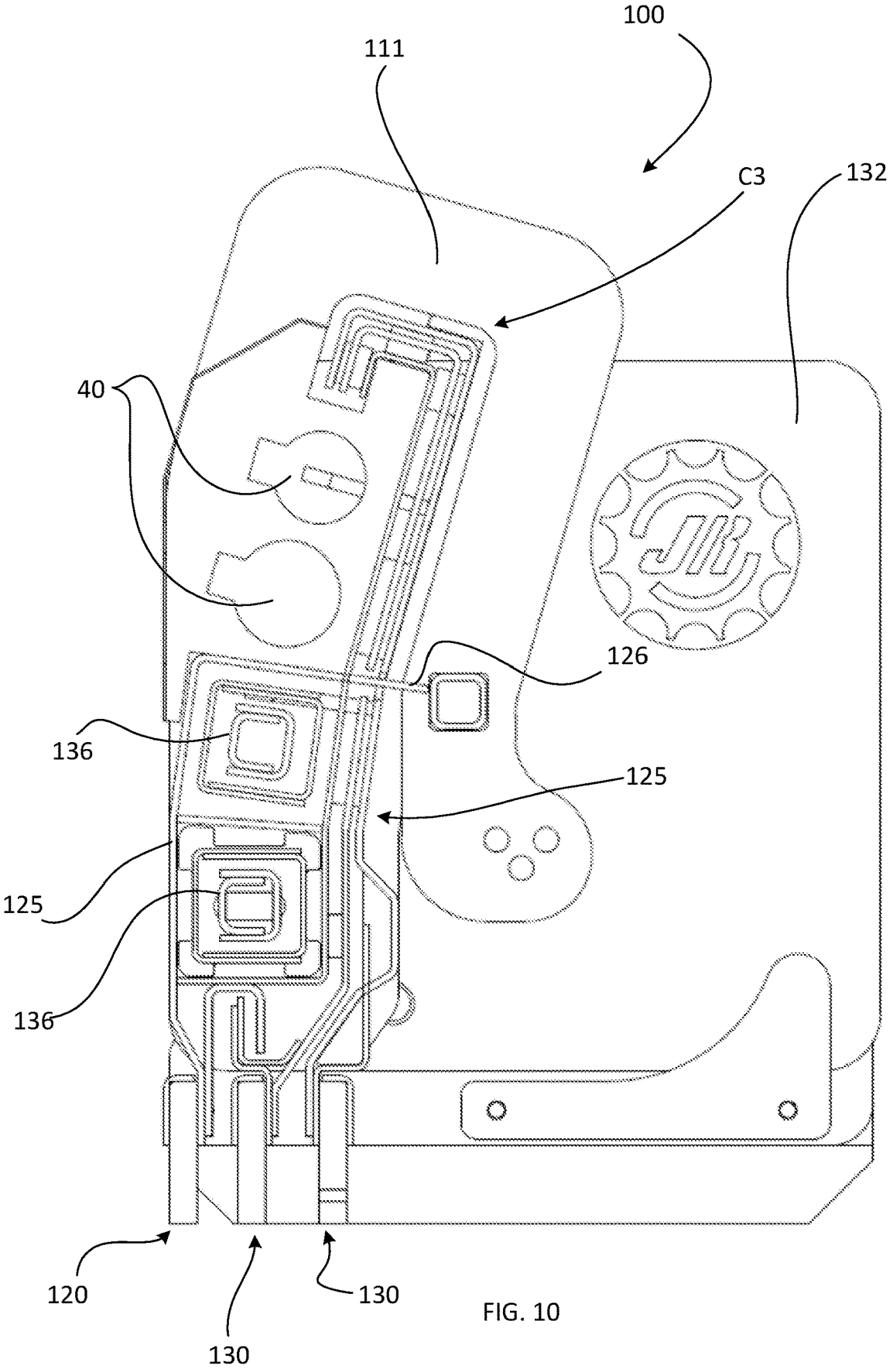
FIG. 10 is a side cutaway view of the plow blade of FIG. 7.

Referring more particularly to FIG. 10 with continued reference to FIGS. 7-9, in the embodiment shown, an overlap is created between the two lateral sections 130 when the plow blade 100 is in the collapsed configuration. In the present case, in the collapsed configuration, the transversal panel 131 of one of the two lateral sections 130 is disposed over the transversal panel 131 of the other of the two lateral sections 130 and the transversal panels 131 of the two lateral sections 130 are disposed in front of the panel 121 of the central section 120. Hence, in the present embodiment, one of the transversal panels 131 of the two lateral sections is sandwiched between the other of the transversal panels 131 of the two lateral sections and the panel 121 of the central section 120. It will be appreciated that, alternatively, other configurations are contemplated without departing from the scope of the present disclosure. For instance, the panel 121 of the central section 120 may be sandwiched between the two lateral sections 130. Although not shown, the plow blade 100 may include stabilizing beams as described above with reference to FIG. 6. The stabilizing beams may be telescopic.

In the embodiment shown, the top portion of the transversal panels 131 of the lateral sections 130 and the top portion of the panel 121 of the central section 120 curves to define C-shaped channels C3. Hence, the top portion of the panel 121 of the central section 120 is slidably received within the C-shaped channel C3 defined by the top portion of one of the transversal panels 131 of the lateral sections 130 and the top portion of the one of the transversal panels 131 of the lateral sections 130 is received within the C-shaped channel C3 defined by the top portion of the other of the transversal panels 131 of the two lateral sections 130.

Bearing or other means may be provided between the top portions to ease sliding motion of the lateral sections 130 in relation to the central section 120.

Still referring to FIG. 10, in the embodiment shown, an extension box 125 defines primary channels C1 to slidably receive the extension beams 136. The extension box 125 is secured to the transversal rib 126. In the present case, the transversal rib 126 is secured to one of the flanges of the extension box 25 and is off-centered relative to the extension box 125.

In the embodiment shown, the width of the plow blade 100 taken in the transversal direction T is 6 feet in the collapsed configuration and 15 feet in the extended configuration. Thus, the plow blade 100 may have a width in the extended configuration that is more than double the width in the collapsed configuration. In an alternate embodiment, the two lateral sections 130 may be free of the two slots 131B. In such a case, the width in the extended configuration may be double the width in the collapsed configuration (e.g., 12 feet vs 6 feet).

Referring now to FIGS. 11-15, another embodiment of a plow blade is shown at 200. For the sake of conciseness, only elements differing from the plow blade 10 described above with reference to FIGS. 1-6 are described below. The plow blade 200 has a central section 220 and two lateral sections 230 that are movable relative to the central section 220 to extend the plow blade 200 from a collapsed configuration shown in FIG. 11 to an extended configuration shown in FIG. 13.

Figure 11:
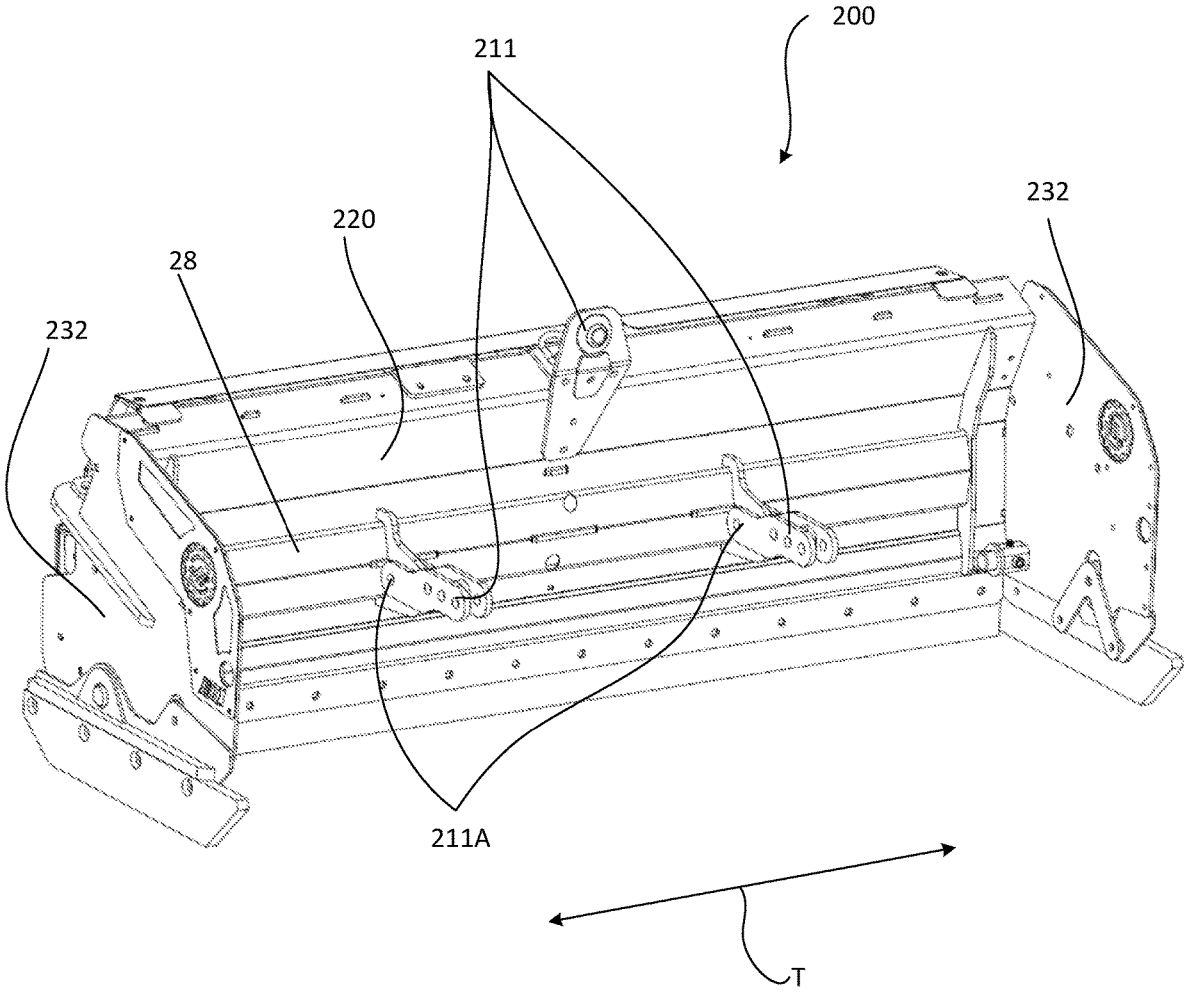
FIG. 11 is a front three dimensional view of a plow blade in accordance with yet another embodiment shown in a collapsed configuration.

As shown in FIG. 11, the plow blade 200 includes three attachment points 211 for securing the plow blade 200 to a vehicle (e.g., tractor). The three attachment points 211 include two brackets secured to the stiffening box 28 and one central top bracket secured to the central panel 220 and located between the two brackets. In the embodiment shown, the two attachment brackets 211 secured to the stiffening box 28 define pivots 211A to permit rotation about an axis parallel to the transversal direction T. This may avoid the vehicle pulling or pushing the snow blade 200 from imparting a moment on the snow blade 200 about an axis parallel to the transversal direction T.

Figure 12:
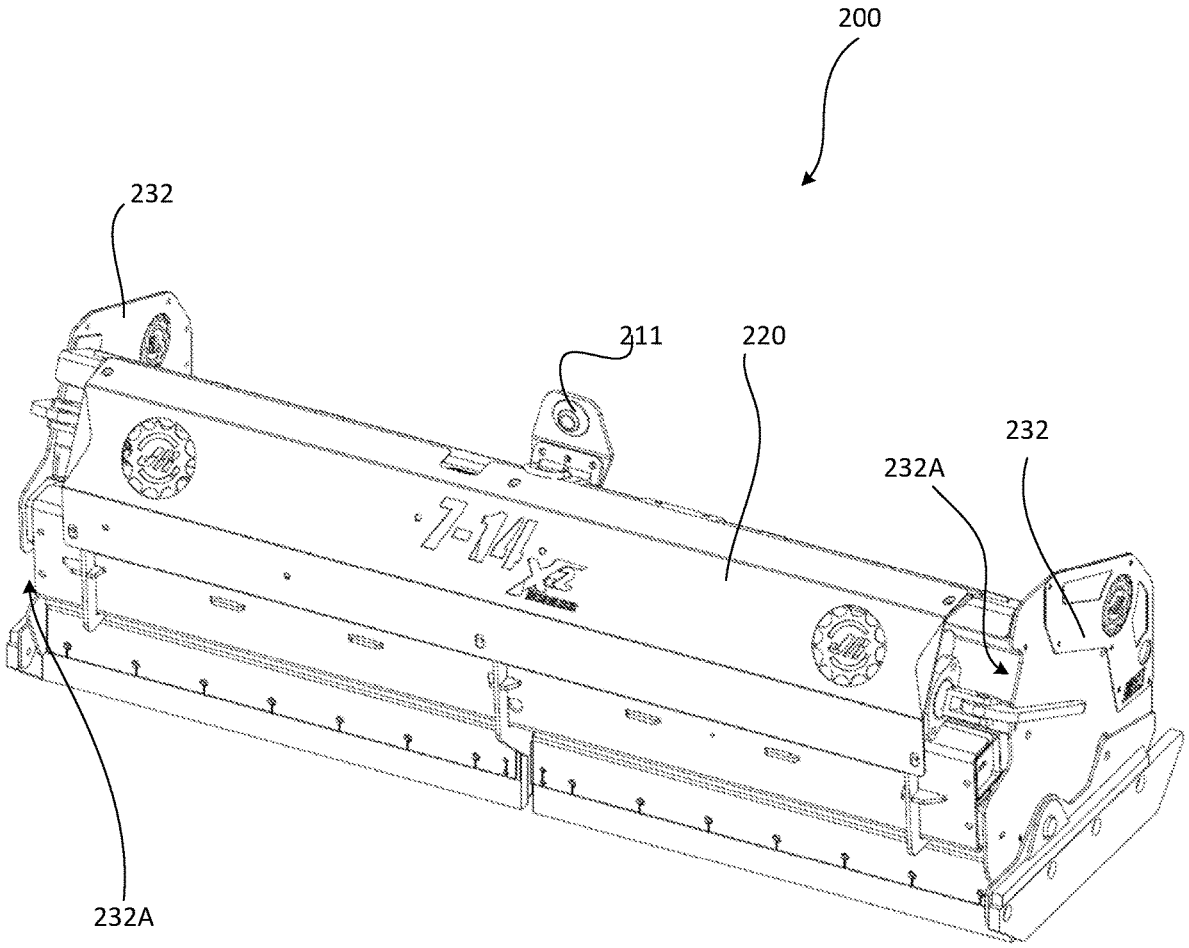
FIG. 12 is a rear three dimensional view of the plow blade of FIG. 11 shown in the collapsed configuration.
Figure 13:
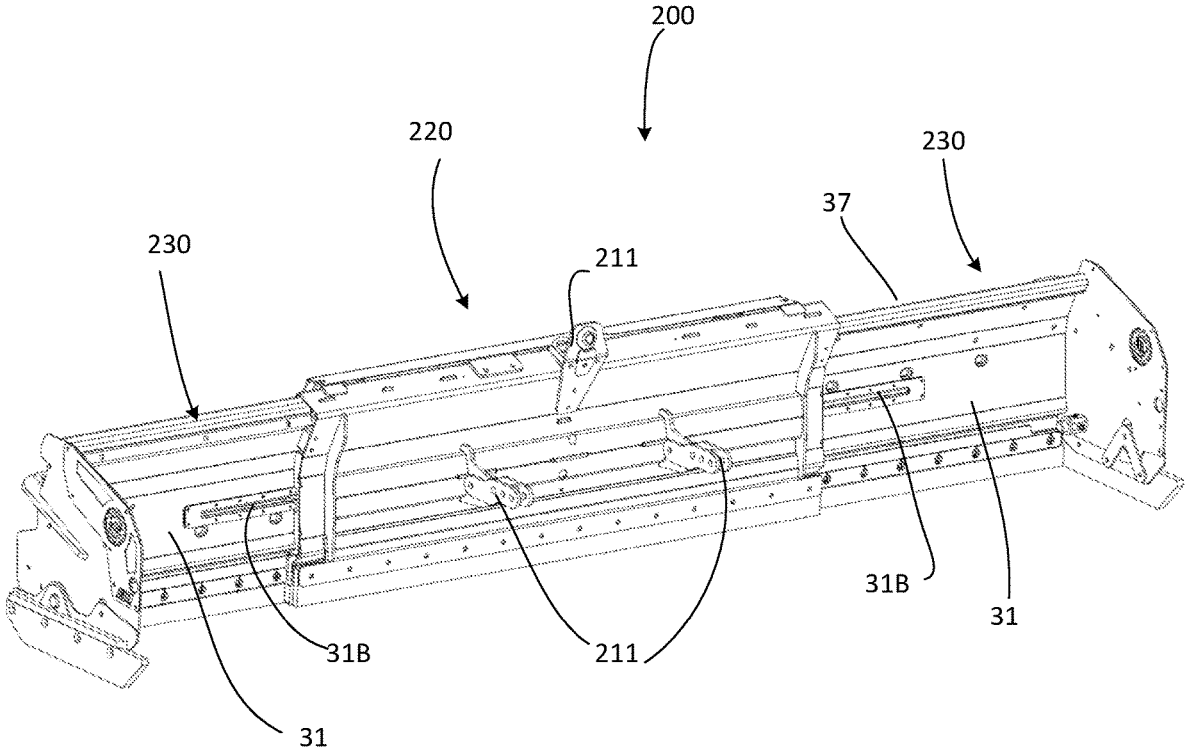
FIG. 13 is a front three dimensional view of the plow blade of FIG. 11 shown in an extended configuration.

As shown in FIG. 12, the two longitudinal panels 232 each define a cut-out 232A. Each of these cut-outs 232A is in register with a respective one of the extension beams 36. One of the cut-outs 232A is located above the other since the two extension beams 36 are disposed atop one another. In use, when the plow blade 200 is being retracted from the extended configuration to the collapsed configuration, the snow is pushed by ends of the extension beams 36 and is evacuated via these cut-outs 232A.

Figure 14:
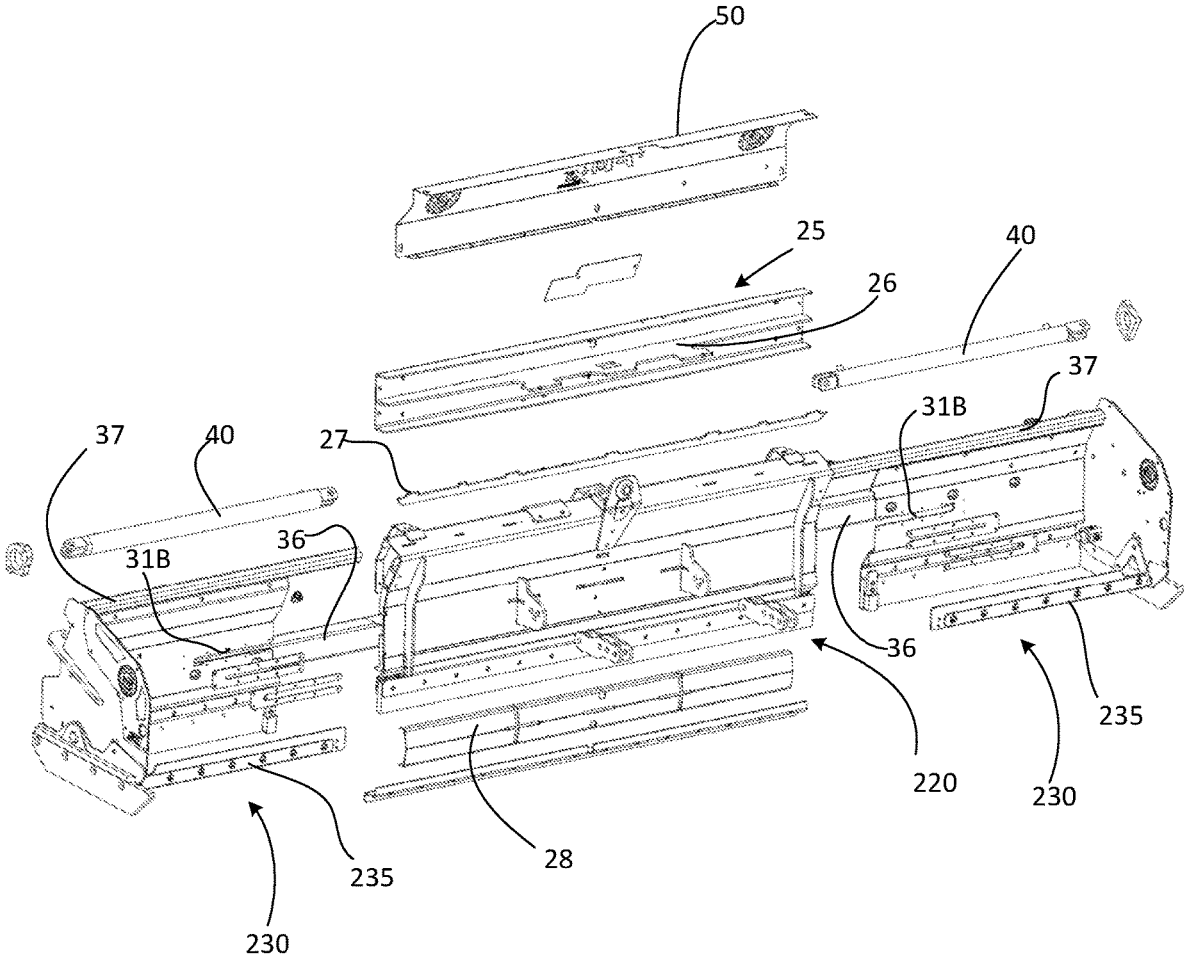
FIG. 14 is a front three dimensional exploded view of the plow blade of FIG. 11.
Figure 15:
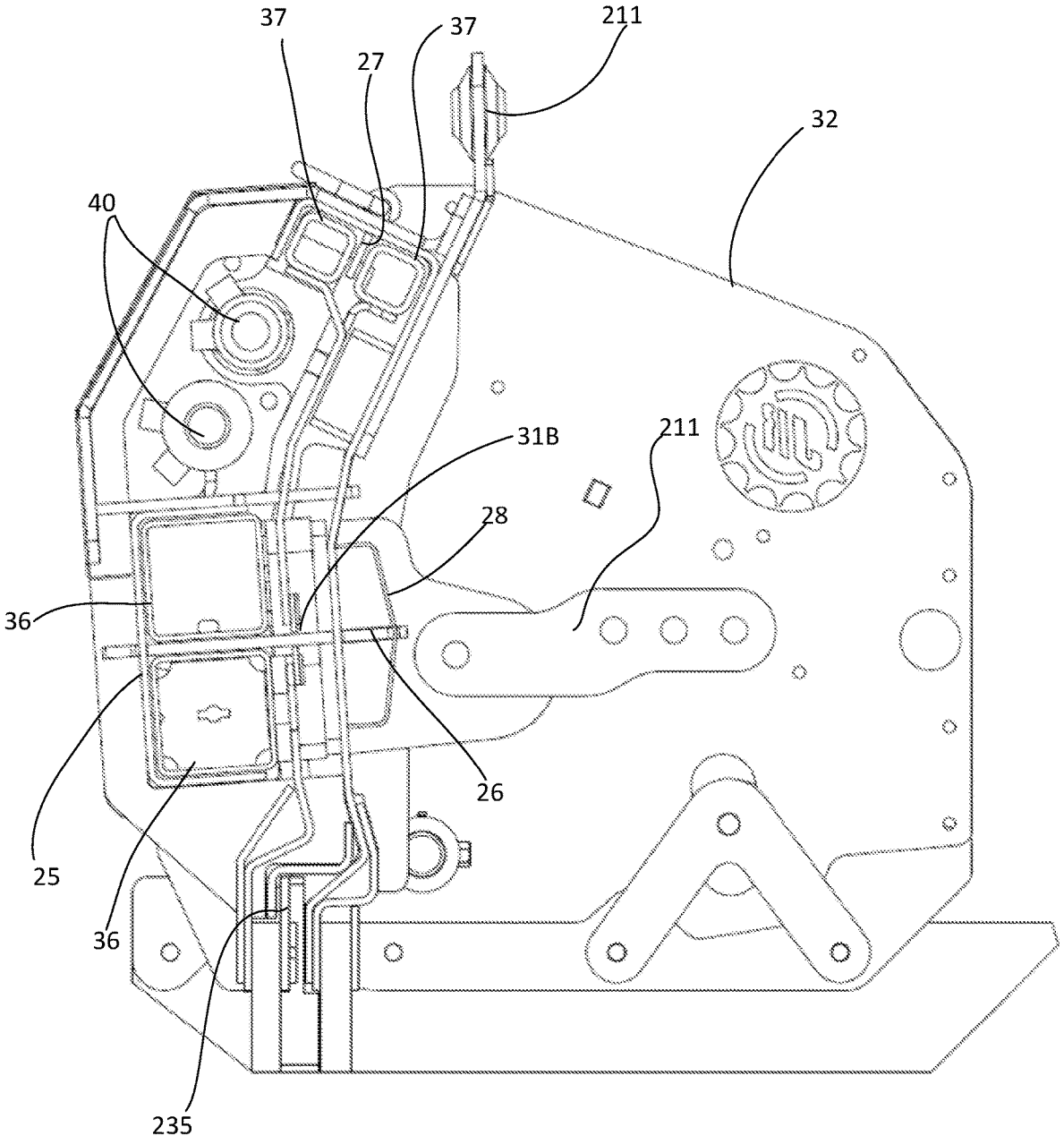
FIG. 15 is a side cutaway view of the plow blade of FIG. 11.

Referring to FIGS. 14-15, in some cases, portions of the lateral sections 230 that are located below the slots 31B may be susceptible to bending about an axis parallel to the vertical direction. As shown in FIG. 15, rails 235 are secured to the lateral sections 230 proximate bottom edges thereof to increase a stiffness of the lateral sections.

In an alternate embodiment, the snow blade may have telescopic lateral sections. In other words, each of the two lateral sections may include two panels movable one relative to the other.

As can be seen therefore, the examples described above and illustrated are intended to be exemplary only. The scope is indicated by the appended claims.

What is claimed is:

1. A plow blade securable to a vehicle, comprising:

a central section having:

a central panel, and a member secured to the central panel via a transversal rib, the member defining at least one channel;

two lateral sections having:

lateral panels having lateral and medial edges, the lateral panels defining slots extending from the medial edges toward the lateral edges, and beams secured to the lateral panels, the beams protruding from the medial edges and away from the lateral edges, the beams slidably received within the at least one channel; and at least one actuator operatively connected to the central section and the two lateral sections for moving the two lateral sections relative to the central section, wherein the two lateral sections are movable relative to the central section between a collapsed configuration and an extended configuration by a sliding motion of the beams within the at least one channel, the two lateral sections being overlapped by the central section in the collapsed configuration and being offset from the central section in the extended configuration, wherein, in the collapsed configuration, portions of the transversal rib are received within the slots, a width of the plow blade in the extended configuration is about double that in the collapsed configuration.

2. The plow blade of claim 1, wherein the member is secured to a first side of the central panel, the transversal rib extending through the central panel from the first side to a second side opposed to the first side.

3. The plow blade of claim 2, comprising at least one attachment member secured to the transversal rib on the second side of the central panel for securing the plow blade to the vehicle, a load path extending from the at least one attachment member on the second side of the central panel to the first side of the central panel via the member and via the transversal rib, a pulling force exerted on the at least one attachment member translated into a pushing force exerted on the beams via the member and via the transversal rib.

4. The plow blade of claim 1, wherein the member is a C-shaped member having a web and two flanges, each of the two flanges protruding from a respective edge of the web, the transversal rib secured to the web, the at least one channel including two channels each located between a respective one of the two flanges and the transversal rib.

5. The plow blade of claim 1, wherein the at least one channel includes two channels separated by the transversal rib.

6. The plow blade of claim 5, wherein the two channels are vertically atop one another.

7. The plow blade of claim 1, wherein the beams are vertically atop one another.

8. The plow blade of claim 1, wherein a top portion of the central panel defines at least one top channel, the two lateral sections having stabilizing beams protruding from the medial edges and slidably received within the at least one top channel.

9. The plow blade of claim 8, wherein the stabilizing beams are in front of one another.

10. The plow blade of claim 9, wherein the at least one top channel includes two top channels, each of the stabilizing beams slidably receivable within a respective one of the two top channels.

11. The plow blade of claim 1, wherein the beams are telescopic.

12. The plow blade of claim 1, comprising friction blocks mounted to the central panel, the friction blocks in contact with the beams and made of a material having a friction coefficient less than that of the beams.

13. The plow blade of claim 1, wherein the at least one actuator includes two actuators, the two actuators overlapping one another.

14. The plow blade of claim 1, comprising longitudinal panels secured to the lateral panels, the longitudinal panels extending transversally to the lateral panels, ends of the beams aligned with apertures or cut-outs defined by the longitudinal panels to allow snow to be pushed out of gaps defined between the longitudinal panels and the ends of the beams.

15. The plow blade of claim 1, wherein a top portion of the central panel defines at least one top channel, the two lateral sections having stabilizing beams protruding from the medial edges and slidably received within the at least one top channel.

16. A plow blade securable to a vehicle, comprising:

a central section having:

a central panel, and a member secured to the central panel via a transversal rib, the member defining at least one channel;

two lateral sections having:

lateral panels having lateral and medial edges, and beams secured to the lateral panels, the beams protruding from the medial edges and away from the lateral edges, the beams slidably received within the at least one channel; and at least one actuator operatively connected to the central section and the two lateral sections for moving the two lateral sections relative to the central section, wherein the two lateral sections are movable relative to the central section between a collapsed configuration and an extended configuration by a sliding motion of the beams within the at least one channel, the two lateral sections being overlapped by the central section in the collapsed configuration and being offset from the central section in the extended configuration, wherein, in the collapsed configuration, portions of the transversal rib are received within slots, a width of the plow blade in the extended configuration is about double that in the collapsed configuration, wherein the member is secured to a first side of the central panel, the transversal rib extending through the central panel from the first side to a second side opposed to the first side.

17. The plow blade of claim 16, comprising at least one attachment member secured to the transversal rib on the second side of the central panel for securing the plow blade to the vehicle, a load path extending from the at least one attachment member on the second side of the central panel to the first side of the central panel via the member and via the transversal rib, a pulling force exerted on the at least one attachment member translated into a pushing force exerted on the beams via the member and via the transversal rib.

18. The plow blade of claim 16, wherein the member is a C-shaped member having a web and two flanges, each of the two flanges protruding from a respective edge of the web, the transversal rib secured to the web, the at least one channel including two channels each located between a respective one of the two flanges and the transversal rib.

19. The plow blade of claim 16, wherein the beams are telescopic beams.

* * * * *